US007373869B2

(12) United States Patent
Pfaff et al.

(10) Patent No.: US 7,373,869 B2
(45) Date of Patent: May 20, 2008

(54) HYDRAULIC SYSTEM WITH MECHANISM FOR RELIEVING PRESSURE TRAPPED IN AN ACTUATOR

(75) Inventors: Joseph L. Pfaff, Wauwatosa, WI (US); Keith A. Tabor, Richfield, WI (US)

(73) Assignee: HUSCO International, Inc., Waukesha, WI (US)

( * ) Notice: Subject to any disclaimer, the term of this patent is extended or adjusted under 35 U.S.C. 154(b) by 282 days.

(21) Appl. No.: 11/373,892

(22) Filed: Mar. 13, 2006

(65) Prior Publication Data

US 2007/0209503 A1 Sep. 13, 2007

(51) Int. Cl.
*F15B 11/10* (2006.01)

(52) U.S. Cl. ..... 91/433

(58) Field of Classification Search ..... 91/433
See application file for complete search history.

(56) References Cited

U.S. PATENT DOCUMENTS 5,138,838 A * 8/1992 Crosser ..... 91/421
6,662,705 B2 * 12/2003 Huang et al. ..... 91/433
6,718,759 B1 4/2004 Tabor
6,732,512 B2 5/2004 Pfaff et al.
6,775,974 B2 8/2004 Tabor
6,880,332 B2 4/2005 Pfaff et al.

* cited by examiner

*Primary Examiner*—F. Daniel Lopez
(74) *Attorney, Agent, or Firm*—Quarles & Brady; George E. Haas

(57) ABSTRACT

Pressure trapped in an inactive hydraulic actuator can result in the actuator moving in a direction which is opposite to that desired upon subsequent activation. The present method detects a trapped pressure condition and takes remedial action before activating the hydraulic actuator for motion. The pressure differentials across valves that control the fluid flow to and from the hydraulic actuator are used to detect a trapped pressure condition. In response to that detection, a selected valve is initially opened in a manner that releases the trapped pressure while producing motion in the desired direction. After the trapped pressure condition has been resolved, one or more other valves are operated to produce the desired motion of the hydraulic actuator.

25 Claims, 5 Drawing Sheets

80

LOGIC TABLE A

| | LOW SIDE EXTEND | STANDARD EXTEND | HIGH SIDE EXTEND | LOW SIDE RETRACT | STANDARD RETRACT |
|---|---|---|---|---|---|
| ΔPa<0 AND ΔPb≥0 | Kvsa = 0<br>Kvar = 0<br>Kvsb = 0<br>Kvbr = Kvbr | IF INLET CHECKS<br>Kvsa = Kvsa<br>Kvar = 0<br>Kvsb = 0<br>Kvbr = Kvbr<br>ELSE<br>Kvsa = 0<br>Kvar = 0<br>Kvsb = 0<br>Kvbr = Kvbr | IF INLET CHECKS<br>Kvsa = -1/2 Kvsa<br>Kvar = 0<br>Kvsb = Kvsb<br>Kvbr = 0<br>ELSE<br>Kvsa = 0<br>Kvar = 0<br>Kvsb = Kvsb<br>Kvbr = 0 | Kvsa = 0<br>Kvar = 0<br>Kvsb = 0<br>Kvbr = Kvbr | Kvsa = 0<br>Kvar = 0<br>Kvsb = Kvsb<br>Kvbr = 0 |
| ΔPa≥0 AND ΔPb<0 | Kvsa = 0<br>Kvar = Kvar<br>Kvsb = 0<br>Kvbr = 0 | Kvsa = Kvsa<br>Kvar = 0<br>Kvsb = 0<br>Kvbr = 0 | Kvsa = Kvsa<br>Kvar = 0<br>Kvsb = 0<br>Kvbr = 0 | Kvsa = 0<br>Kvar = Kvar<br>Kvsb = 0<br>Kvbr = 0 | IF INLET CHECKS<br>Kvsa = 0<br>Kvar = Kvar<br>Kvsb = Kvsb<br>Kvbr = 0<br>ELSE<br>Kvsa = 0<br>Kvar = Kvar<br>Kvsb = 0<br>Kvbr = 0 |

FIG. 5

80

LOGIC TABLE A

| | LOW SIDE EXTEND | STANDARD EXTEND | HIGH SIDE EXTEND | LOW SIDE RETRACT | STANDARD RETRACT |
|---|---|---|---|---|---|
| ΔPa<0 AND ΔPb≥0 | Kvsa = 0<br>Kvar = 0<br>Kvsb = 0<br>Kvbr = Kvbr | IF INLET CHECKS<br>Kvsa = Kvsa<br>Kvar = 0<br>Kvsb = 0<br>Kvbr = Kvbr<br><br>ELSE<br>Kvsa = 0<br>Kvar = 0<br>Kvsb = 0<br>Kvbr = Kvbr | IF INLET CHECKS<br>Kvsa = -1/2 Kvsa<br>Kvar = 0<br>Kvsb = Kvsb<br>Kvbr = 0<br><br>ELSE<br>Kvsa = 0<br>Kvar = 0<br>Kvsb = Kvsb<br>Kvbr = 0 | Kvsa = 0<br>Kvar = 0<br>Kvsb = 0<br>Kvbr = Kvbr | Kvsa = 0<br>Kvar = 0<br>Kvsb = Kvsb<br>Kvbr = 0 |
| ΔPa≥0 AND ΔPb<0 | Kvsa = 0<br>Kvar = Kvar<br>Kvsb = 0<br>Kvbr = 0 | Kvsa = Kvsa<br>Kvar = 0<br>Kvsb = 0<br>Kvbr = 0 | Kvsa = Kvsa<br>Kvar = 0<br>Kvsb = 0<br>Kvbr = 0 | Kvsa = 0<br>Kvar = Kvar<br>Kvsb = 0<br>Kvbr = 0 | IF INLET CHECKS<br>Kvsa = 0<br>Kvar = Kvar<br>Kvsb = Kvsb<br>Kvbr = 0<br><br>ELSE<br>Kvsa = 0<br>Kvar = Kvar<br>Kvsb = 0<br>Kvbr = 0 |

FIG. 6

82

LOGIC TABLE B

| | LOW SIDE EXTEND | STANDARD EXTEND | HIGH SIDE EXTEND | LOW SIDE RETRACT | STANDARD RETRACT |
|---|---|---|---|---|---|
| $\Delta Pa<0$ AND $\Delta Pb\geq 0$ | Kvsa=MIN($Kv_{PRE}$,Kvsa)<br>Kvar=MAX(-$Kv_{PRE}$,Kvar)<br>Kvsb = 0<br>Kvbr = Kvbr | IF INLET CHECKS<br>Kvsa = Kvsa<br>Kvar = 0<br>Kvsb = 0<br>Kvbr = Kvbr<br><br>ELSE<br>Kvsa=MIN($Kv_{PRE}$,Kvsa)<br>Kvar = 0<br>Kvsb = 0<br>Kvbr = Kvbr | IF INLET CHECKS<br>Kvsa = -1/2 Kvsa<br>Kvar = 0<br>Kvsb = Kvsb<br>Kvbr = 0<br><br>ELSE<br>Kvsa=MIN($Kv_{PRE}$,Kvsa)<br>Kvar = 0<br>Kvsb = Kvsb<br>Kvbr = 0 | Kvsa = 0<br>Kvar=MIN($K_{PRE}$,Kvar)<br>Kvsb = 0<br>Kvbr = Kvbr | Kvsa = 0<br>Kvar = MIN ($Kv_{PRE}$, Kvar)<br>Kvsb = Kvsb<br>Kvbr = 0 |
| $\Delta Pa\geq 0$ AND $\Delta Pb<0$ | Kvsa = MIN($Kv_{PRE}$,Kvsa)<br>Kvar = Kvar<br>Kvsb = 0<br>Kvbr = MIN($Kv_{PRE}$,Kvbr) | Kvsa = Kvsa<br>Kvar = 0<br>Kvsb = 0<br>Kvbr=MIN($Kv_{PRE}$,Kvbr) | Kvsa = Kvsa<br>Kvar = 0<br>Kvsb=MAX(-$Kv_{PRE}$,Kvsb)<br>Kvbr = 0 | Kvsa = 0<br>Kvar = Kvar<br>Kvsb = 0<br>Kvbr=MAX(-$Kv_{PRE}$,Kvbr) | IF INLET CHECKS<br>Kvsa = 0<br>Kvar = Kvar<br>Kvsb = Kvsb<br>Kvbr = 0<br><br>ELSE<br>Kvsa = 0<br>Kvar = Kvar<br>Kvsb = MIN($Kv_{PRE}$, Kvsb)<br>Kvbr = 0 |

HYDRAULIC SYSTEM WITH MECHANISM FOR RELIEVING PRESSURE TRAPPED IN AN ACTUATOR

CROSS-REFERENCE TO RELATED APPLICATIONS

Not Applicable.

STATEMENT REGARDING FEDERALLY SPONSORED RESEARCH OR DEVELOPMENT

Not Applicable.

BACKGROUND OF THE INVENTION

1. Field of the Invention

The present invention relates to hydraulic systems for operating machinery, and in particular to electronic circuits that operating valves to control the flow of fluid in such hydraulic systems.

2. Description of the Related Art

A wide variety of machines have components that are moved by an hydraulic actuator, such as a cylinder and piston arrangement, which is controlled by a valve assembly. Traditionally a manually operated spool type hydraulic valve was used to control the fluid flow to and from the actuator. There is a present trend toward electrical controls and the use of solenoid operated valves. With this type of control, pressurized fluid from a pump is applied to one chamber of the hydraulic cylinder by opening a first solenoid operated, proportional poppet valve and at the same time a second solenoid operated, proportional poppet valve is opened to allow the fluid in the other cylinder chamber to flow back to the system tank.

When those valves close, i.e. when motion of the piston in the hydraulic cylinder is not desired, pressure often becomes trapped in the cylinder chambers thereby affecting the workport pressure at the valve assembly. Trapped pressure of a significant magnitude can produce undesired motion when the valves reopen to activate the hydraulic actuator again. For example, load "droop" when the trapped pressures are released when both valves are modulated without taking the initial workport pressure into account. Depending upon the trapped workport pressure states, supply and return pressures, the metering mode and the direction of the commanded motion, the condition can result in the piston initially moving slightly in the wrong direction when small magnitudes of fluid flow are being sent to the hydraulic actuator. As a result, the machine member driven by the hydraulic actuator may shudder during a transition period while the pressures normalize. Such unexpected motion of the components driven by the hydraulic actuator are disturbing to the machine operator.

The existence of trapped pressure that may result in such undesired motion upon subsequent operation of the associated hydraulic actuator is referred to herein as a "trapped pressure condition." The trapped pressure condition can be produced by the relative closing times of the inlet and outlet valves, a relief valve opening for one of the cylinder chambers but not the other chamber, thermal effects, and valve and cylinder leakage.

Prior manual spool values partially compensated for the effects produced by the trapped pressures by opening the return passage from workport to tank through the spool slightly before the passage from the supply line to another workport opened. However, this only compensated for the bootstrap effect.

Present day electrically controlled hydraulic functions use separate pairs of solenoid operated valves to connect each cylinder chamber to the fluid supply and return lines. This arrangement allows use of more metering modes that just standard powered extension and powered retraction of the cylinder provided by conventional spool valves. Specifically several regeneration modes are available by opening the solenoid operated valves in different combinations, as described in U.S. Pat. No. 6,775,974. Any one of several metering modes can be used to produce the same motion of the hydraulic actuator, with the particular mode to use depending upon the operating conditions at a given point in time. Providing the capability of selecting among a plurality of metering modes significantly complicates the alleviating the undesirable effects due to a trapped pressure condition.

Therefore, a mechanism still is needed to reduce or eliminate the shudder and other effects produced by pressure trapped in the hydraulic cylinder and ensure that the machine member will move only in the commanded direction.

SUMMARY OF THE INVENTION

An exemplary hydraulic system that incorporates the present invention has a first control valve that couples a hydraulic actuator to a supply line containing pressurized fluid and a second control valve coupling the hydraulic actuator a return line connected to a tank. Additional control valve may be provided in bidirectional motion of the actuator is desired.

The method for counteracting the undesirable effects from trapped pressure in the inactive hydraulic actuator is carried out upon receiving a command indicating desired motion of the hydraulic actuator. A first pressure differential that exists across the first control valve and a second pressure differential that exists across the second control valve are determined. In a preferred embodiment, those pressure differentials are determined by sensing the pressures on opposite sides of the respective valve and calculating the difference between the sensed pressures. Whether a trapped pressure condition exists in the hydraulic actuator is ascertained from at least one of the first and second pressure differentials, in which case an active indication of the trapped pressure condition is produced. In general, given a desired velocity and metering mode, the steady direction of the pressure differential that should exist is known. Therefore when that pressure differential direction is opposite to a measured pressure differential, trapped pressure exists.

When the indication is active, one of the first control valve and the second control valve is opened to release the trapped pressure. Which valve is opened is determined by the metering mode in which the hydraulic actuator is intended to be operated. Thereafter a determination is made based on a change in at least one of the first and second pressure differentials, when the trapped pressure condition no longer exists, in which event the other of the first and second valve is opened to produce the desired motion of the hydraulic actuator. Therefore, the full opening of the valves and thus operation of the hydraulic actuator occurs only after the trapped pressure has been mitigated to a level at which motion of the hydraulic actuator only will occur in the desired manner.

When the indication is inactive, i.e. a trapped pressure condition does not exist when it is desired to operate the hydraulic actuator, both the first control valve and the second control valve are immediately opened to produce the commanded motion of the hydraulic actuator.

A version of the present method for counteracting the effects of a trapped pressure condition also is described for a hydraulic function that has two pairs of valves connected to each chamber of a double acting cylinder to provide bidirectional, independent meter-in and meter-out operation. Mitigation of the trapped pressure condition also is described for a plurality of metering modes, including standard powered metering modes and several regeneration metering modes.

BRIEF DESCRIPTION OF THE DRAWINGS

FIG. 5 is a table defining the conductance coefficients for several of the states in the diagram of FIG. 3; and FIG. 6 is a table defining alternative conductance coefficients for several of the states in the diagram of FIG. 3.

DETAILED DESCRIPTION OF THE INVENTION

Figure 1:
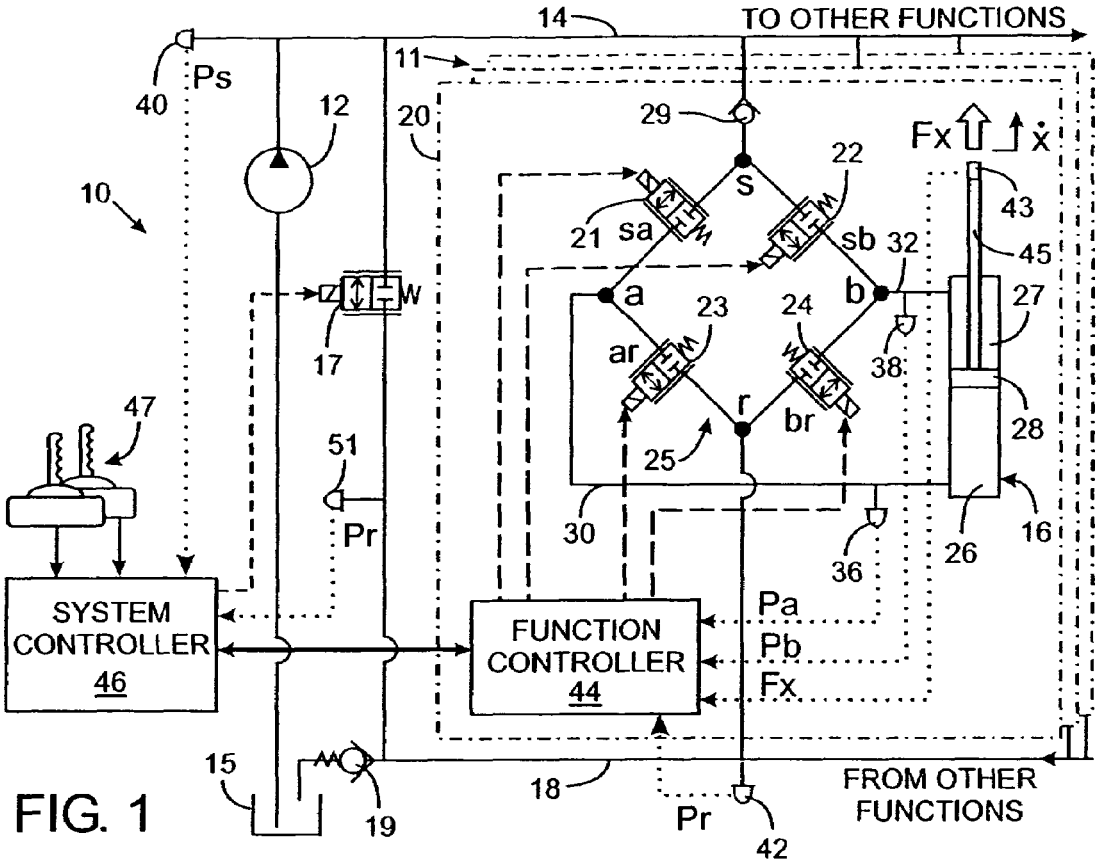
FIG. 1 is a schematic diagram of an exemplary hydraulic system that has a plurality of hydraulic functions.

With initial reference to FIG. 1, a machine has a hydraulic system 10 that provides a plurality of hydraulic functions which operate various components of the machine by means of fluid powered actuators, such as a cylinder 16 or rotational motors. For example, different hydraulic functions control movement of a boom, an arm and a bucket of a backhoe used on construction projects. The exemplary hydraulic system 10 includes a positive displacement pump 12 that is driven by an engine or an electric motor (not shown) to draw hydraulic fluid from a tank 15 and furnish the hydraulic fluid under pressure to a supply line 14. The supply line 14 is connected to a tank return line 18 by an unloader valve 17 and the return line 18 is connected by a check valve 19 to the system tank 15. The unloader and tank control valves are dynamically operated to control the pressure in the associated line.

The supply line 14 and the tank return line 18 are connected to the plurality of hydraulic functions on the machine on which the hydraulic system 10 is located. One of those functions 20 is illustrated in detail and other functions 11 have similar components. The hydraulic system 10 is a distributed type in that the valves for each function and control circuitry for operating those valves are located adjacent to the actuator for that function.

In the given function 20, the supply line 14 is connected by an inlet check valve 29 to node "s" of a valve assembly 25 which has a node "r" connected to the tank return line 18. The valve assembly 25 includes a workport node "a" that is connected by a first hydraulic conduit 30 to the head chamber 26 of the cylinder 16, and has another workport node "b" coupled by a second conduit 32 to the rod chamber 27 of the cylinder. Four electrohydraulic, pilot-operated, proportional valves 21, 22, 23, and 24 control the flow of hydraulic fluid between the nodes of the valve assembly 25 and thus control fluid flow to and from the cylinder 16. The first electrohydraulic proportional valve 21 is connected between nodes "s" and "a", and is designated by the letters "sa". Thus the first electrohydraulic proportional valve 21 controls the flow of fluid between the supply line 14 and the head chamber 26. The second electrohydraulic proportional valve 22, denoted by the letters "sb", is connected between nodes "s" and "b" and controls fluid flow between the supply line 14 and the cylinder rod chamber 27. The third electrohydraulic proportional valve 23, designated by the letters "ar", is connected between node "a" and node "r" to control flow between the head chamber 26 and the return line 18. The fourth electrohydraulic proportional valve 24, which is between nodes "b" and "r" and designated by the letters "br", can control the flow between the rod chamber 27 and the return line 18.

The hydraulic components for the given function 20 also include two pressure sensors 36 and 38 which detect the pressures Pa and Pb within the head and rod chambers 26 and 27, respectively, of cylinder 16. Another pressure sensor 40 measures the supply line pressure Ps, while pressure sensor 42 detects the return line pressure Pr at node "r" of the valve assembly 25.

The pressure sensors 36, 38, 40 and 42 provide input signals to a function controller 44 which produces signals that operate the four electrohydraulic proportional valves 21-24. The function controller 44 is a microcomputer based circuit which receives other input signals from a system controller 46, as will be described. A software program executed by the function controller 44 responds to those input signals by producing output signals that selectively open the four electrohydraulic proportional valves 21-24 by specific amounts to properly operate the cylinder 16.

The system controller 46 supervises the overall operation of the hydraulic system 10 exchanging data and commands with the function controllers 44 over a communication link 55 using a conventional message protocol. The system controller 46 also receives signals from a pressure sensor 40 at the outlet of the pump 12 and a return line pressure sensor 51. The unloader valve 17 is operated by the system controller 46 in response to those pressure signals.

Figure 2:
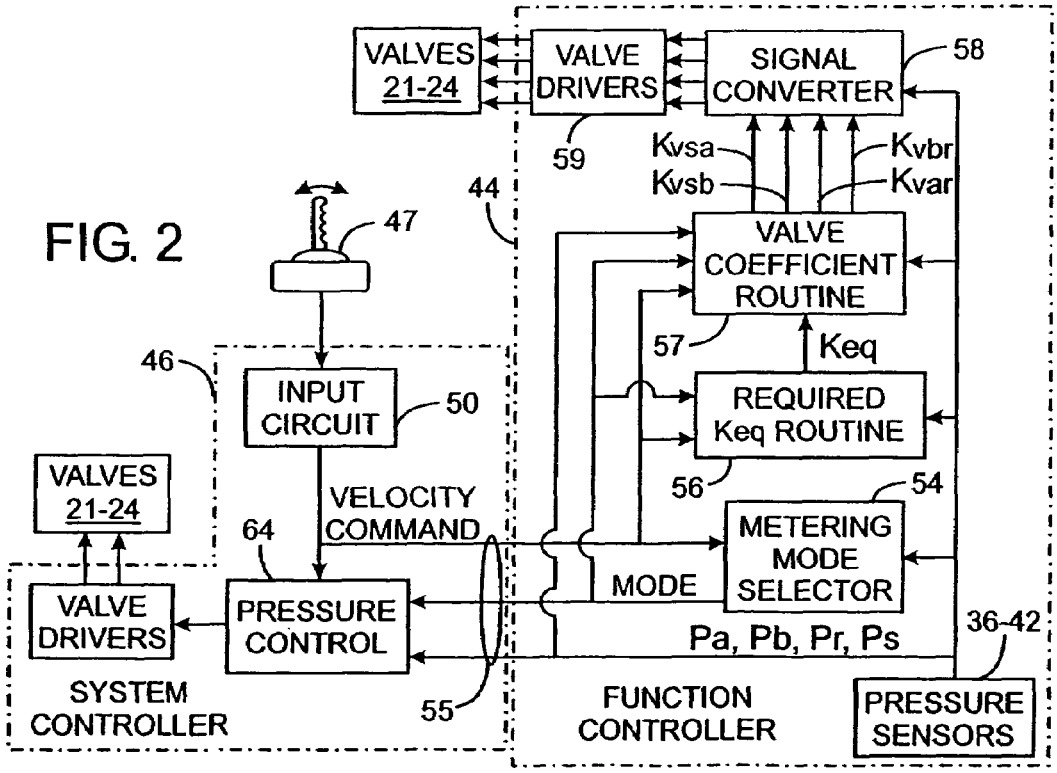
FIG. 2 is a control diagram for one of the hydraulic functions.

With reference to FIG. 2, the control functions for the hydraulic system 10 are distributed among controllers 44 and 46. Considering a single function 20, the output signals from the joystick 47 for that function are inputted to the system controller 46. Specifically, the output signal from the joystick 47 is applied to an input circuit 50 which converts the signal indicating the joystick position into a motion signal, in the form of a velocity command indicating a desired velocity for the hydraulic actuator 16.

The resultant velocity command is sent to the function controller 44 which operates the electrohydraulic proportional valves 21-24 that control the hydraulic actuator 16 for the associated function 20. When the function has a hydraulic cylinder 16 and piston 28 as in FIG. 1, hydraulic fluid is supplied to the head chamber 26 to extend the piston rod 45 from the cylinder or is supplied to the rod chamber 27 to retract the piston rod 45. The desired velocity of the rod in one of those directions can be achieved by metering fluid through the valves 21-24 in several different paths, referred to as metering modes.

The fundamental metering modes in which fluid from the pump 12 is supplied to one of the cylinder chambers 26 or 27 and drained to the return line from the other chamber are referred to as "powered metering modes" or "standard metering modes" and specifically standard extend and standard retract modes. In these metering modes one of the valves 21 or 22 is opened to convey fluid from the supply line 14 to one chamber of the cylinder 16 and one of the valves 24 or 23, respectively, is opened to convey fluid from the other cylinder chamber to the return line 18. The hydraulic function 20 also may operate in a regeneration metering mode in which fluid exhausting from one cylinder chamber is fed back through the valve assembly 25 to supply the other cylinder chamber which is expanding. In a regeneration mode, the fluid can flow between the chambers through either the supply line node "s", referred to as the "high side" or through the return line node "r" referred to as the "low side". Note in the low side retract mode, a greater volume of fluid is draining from the head chamber 26 than is required to fill the smaller rod chamber 27. In this case, the excess fluid enters the return line 18 from which it continues to flow either to the tank 15 or to another function 11. When the hydraulic system operates in the high side extend mode in which fluid is regeneratively forced from the rod chamber 27, additional fluid required to fill the larger head chamber 26 is supplied from the supply line 14.

The metering mode to use is chosen by a metering mode selector 54 for the associated hydraulic function. The metering mode selector 54 is implemented by a software algorithm executed by the function controller 44 to determine the optimum metering mode for the present operating conditions. The software selects the metering mode in response to the cylinder chamber pressures Pa and Pb and the supply and return lines pressures Ps and Pr at the particular function. Once selected, the metering mode is communicated to the system controller 46 and other routines of the respective function controller 44. Selection of the metering mode may utilize the process described in U.S. Pat. No. 6,880,332, which description is incorporated herein by reference.

Valve Control

The function controller 44 also executes software routines 56 and 57 to determine how to operate the electrohydraulic proportional valves 21-24 to achieve the commanded velocity and required workport pressures. The hydraulic circuit branch for the function 20 can be modeled by a single coefficient (Keq) representing the equivalent fluid conductance of that branch in the selected metering mode. The circuit branch for exemplary hydraulic function 20 includes the valve assembly 25 connected to the cylinder 16. The equivalent conductance coefficient Keq then is used to calculate a set of individual valve conductance coefficients (Kvsa, Kvsb, Kvar, and Kvbr), which characterize fluid flow through each of the four electrohydraulic proportional valves 21-24 and thus the amount, if any, that each valve is to open. Those skilled in the art will recognize that in place of these conductance coefficients, the inversely related flow restriction coefficients can be used to characterize the fluid flow. Both conductance and restriction coefficients characterize the flow of fluid in a section or component of a hydraulic system and are inversely related parameters. Therefore, the generic terms "equivalent flow coefficient" and "valve flow coefficient" are used herein to cover both conductance and restriction coefficients.

The nomenclature used to describe the algorithms which implement the present control technique is given in Table 1.

TABLE 1

| NOMENCLATURE | |
|---|---|
| a | denotes items related to head side of cylinder |
| b | denotes items related to rod side of cylinder |

TABLE 1-continued

| NOMENCLATURE | |
|---|---|
| Kvsa | conductance coefficient for valve sa between supply line and node a |
| Kvsb | conductance coefficient for valve sb between supply line and node b |
| Kvar | conductance coefficient for valve ar between node a and return line |
| Kvbr | conductance coefficient for valve br between node b and return line |
| Keq | equivalent conductance coefficient |
| Pa | cylinder head chamber pressure |
| Pb | cylinder rod chamber pressure |
| Ps | supply line pressure |
| Pr | return line pressure |
| $\dot{x}$ | commanded velocity of the piston (positive in the extend direction) |

The mathematical derivation of the equivalent conductance coefficient (Keq) and the set of individual valve conductance coefficients (Kvsa, Kvsb, Kvar and Kvbr), for each electrohydraulic proportional valve 21-24, is described in detail in U.S. Pat. No. 6,775,974, which description is incorporated herein by reference. That derivation of the conductance coefficients depends on the metering mode selected for the hydraulic function 20. Specifically the equivalent conductance coefficient (Keq) is produced by the function controller 44 executing software routine 56. The equivalent conductance coefficient then is used by the valve coefficient routine 57, along with the metering mode and the sensed pressures, to calculate an initial set of values for the valve conductance coefficients Kvsa, Kvsb, Kvar and Kvbr.

Instead of employing that initial set of valve conductance coefficients to operate the valves as was done in the system described in the aforementioned U.S. patent, the present valve coefficient routine 57 determines whether a trapped pressure condition exists and if so, adjusts the valve conductance coefficients as necessary, so that the valves initially operate in a manner that alleviates the trapped pressure. When the trapped pressure condition no longer exists, the initial set of valve conductance coefficients are used directly to operated the control valves 21-24.

Figure 3:
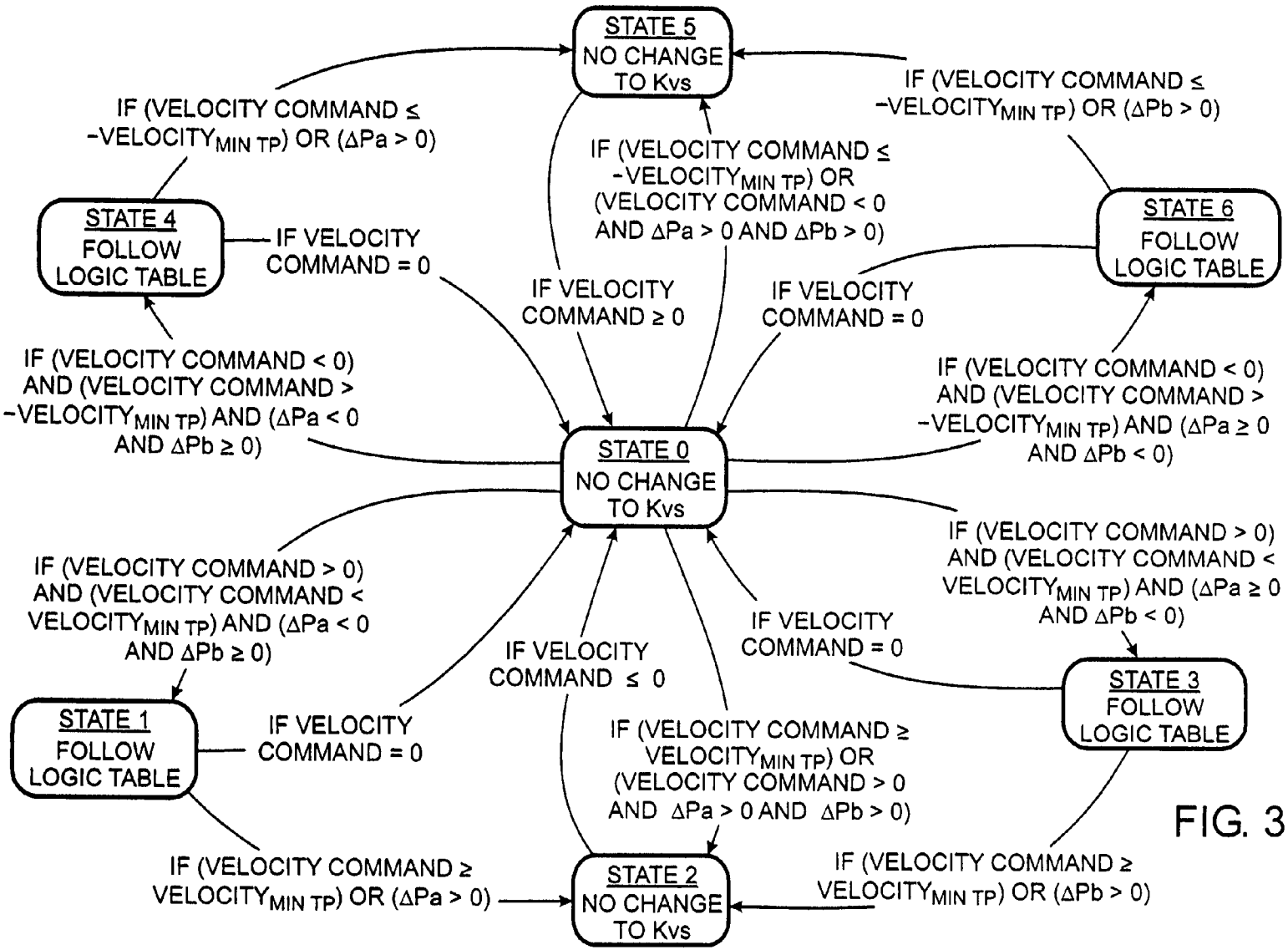
FIG. 3 is a state diagram of the process for determining a conductance coefficient for each control valve of a hydraulic function.
Figure 4:
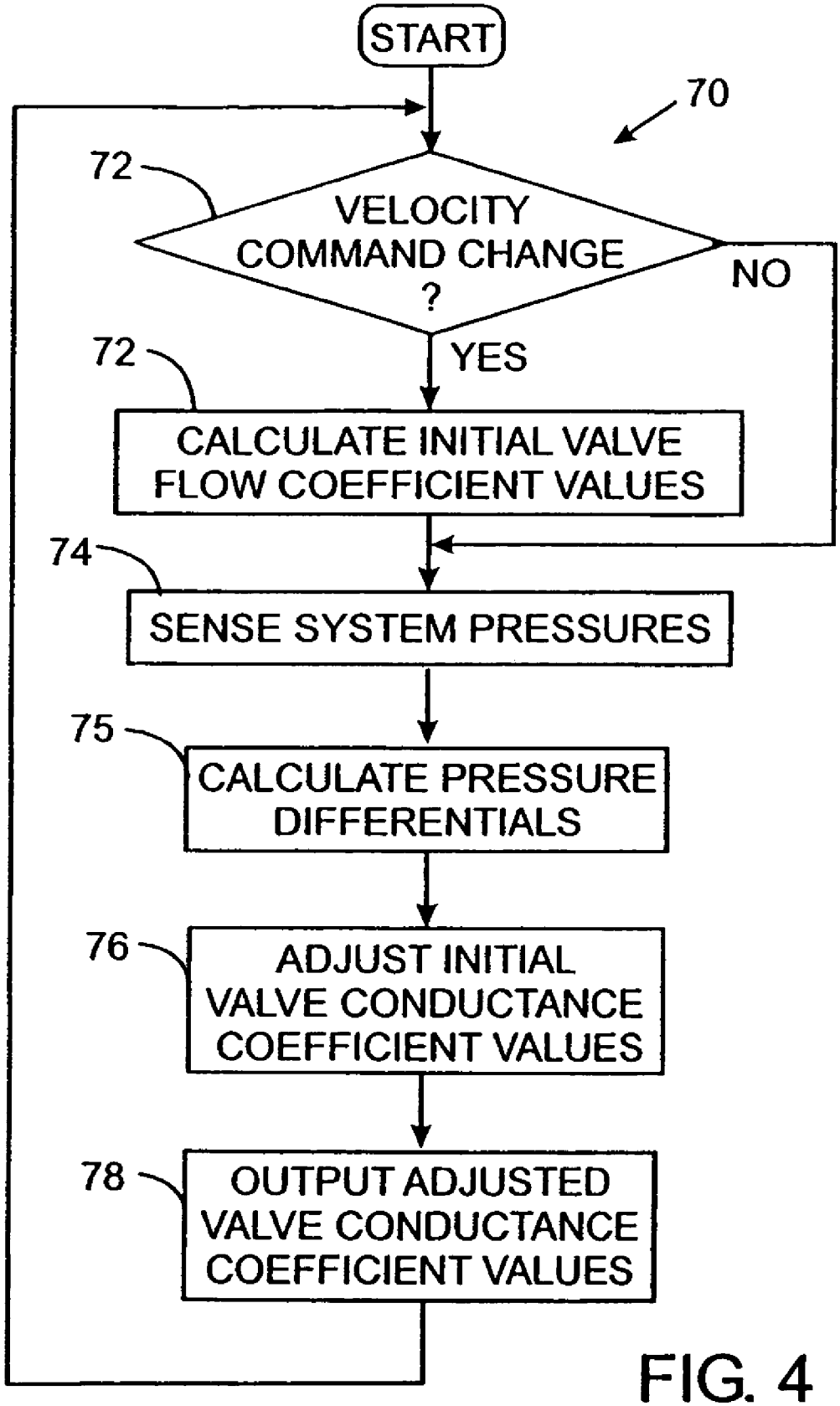
FIG. 4 is a flow chart of the processing step that occur at each state in FIG. 3.

The valve coefficient routine 57 is implements as a state machine that is depicted by the state diagram of FIG. 3. At each state the function controller 44 executes a series of steps as shown in the flowchart 70 of FIG. 4. The process commences by determining whether the velocity command has changed, in which event a new set of initial valve conductance coefficients are calculated at step 72.

For the desired motion of the piston rod 45 to occur, a given metering mode requires that fluid flow in a specific path through the valve assembly 25 and for that flow to occur, the fluid source must have a greater pressure than the recipient of the flow. That pressure relationship is defined as a positive pressure differential across the each valve that is to open. The pressure differentials are designated ΔPa for the active valve connected to node "a" of the valve assembly 25 and ΔPb for the active valve connected to "b". If either pressure differential is negative, as can occur with trapped pressure in the cylinder, then the fluid will flow through the associated valve in the opposite direction to that required to produce the desired motion.

Therefore, at step 74 the pressures at nodes "a", "b", "s" and "r" in the valve assembly 25, that are measured by sensors 36, 38, 40 and 42, are read by the function controller 44. Then the appropriate pressure differentials are calculated ate step 75 using the sensed pressures in the valve assembly. The pressure differentials for the selected metering mode are given by the following equations:

Low Side Extend:

$\Delta Pa = Pr - Pa$ $\Delta Pb = Pb - Pr$

Standard Extend:

$\Delta Pa = Ps - Pa$ $\Delta Pb = Pb - Pr$

High Side Extend:

$\Delta Pa = Ps - Pa$ $\Delta Pb = Pb - Ps$

Low Side Retract:

$\Delta Pa = Pa - Pr$ $\Delta Pb = Pr - Pb$

Standard Retract:

$\Delta Pa = Pa - Pr$ $\Delta Pb = Ps - Pb$

The valve coefficient routine 57 then utilizes the two pressure differentials and the velocity command to determine the whether a trapped pressure condition exists and then how to adjust the valve conductance coefficients to alleviate that condition. With reference to the state diagram in FIG. 3 a determination is made in the currently active state whether the predefined conditions exist for a transition to another state. Operation in State 0 occurs when the operator is not commanding motion of the hydraulic function 20 and thus the initial set of individual valve conductance coefficients (Kvsa, Kvsb, Kvar and Kvbr) do not require adjustment. In this state, step 76 of the flowchart 70 does not alter the initial valve conductance coefficients which are then outputted at step 78 by the valve coefficient routine 57 to the signal converter 58 in FIG. 2.

When motion is commanded by operation of joystick 47, the valve coefficient routine 57 analyzes the velocity command and the two pressure differentials ΔPa and ΔPb that were calculated based on the selected metering mode. Depending upon the outcome of that evaluation, a transition occurs from State 0 to one of the other six states as depicted by the diagram in FIG. 3. When the velocity command designates motion in the positive direction, arbitrarily defined as piston rod extend as indicated by the $\dot{x}$ arrow in FIG. 1, the valve coefficient routine 57 operates in either State 1, 2 or 3 in the lower half of the state diagram in FIG. 3. Alternatively, negative commanded motion, i.e. piston rod retract, results in the operation in State 4, 5 or 6 in the upper half of the state diagram.

A transition from State 0 to State 1 occurs if the velocity command is greater than zero (i.e. positive motion) and is less than a velocity threshold that requires trapped pressure be mitigated. It should be understood that if the operator commands a relatively high velocity, the valves will open to such a large degree that motion rapidly occurs in the desired direction, mitigating the need to alleviate the trapped pressure, since the reverse motion will be so small in comparison to the commanded motion. Therefore, the valve coefficient routine 57 only adjusts the valve conductance coefficients when the commanded velocity is less than a predefined velocity threshold, designated $\text{VELOCITY}_{MIN\ TP}$. In addition, the transition from State 0 to State 1 requires that pressure differential ΔPa be less than zero and pressure differential ΔPb be greater than or equal to zero.

While in State 1, the valve conductance coefficients are adjusted at step 76 as defined in the Logic Table A in FIG. 5 which is a two dimensional table having different sets of adjustment factors in each table cell. The selection of a particular cell to utilize in a given State is determined based on the values of the two pressure differentials which select a row of Logic Table A and based on the active metering mode which selects a table column. The cell at the intersection of that row and column provides the definition of the valve conductance coefficient adjustments. In State 1, ΔPa is less than zero and ΔPb is greater than or equal to zero which indicates that the cells in the upper row of Logic Table A will be utilized. In addition, assume for example that the low side extend metering mode is active, in which valves 21, 23 and 24 are to open so that fluid is routed from the rod chamber into the head chamber with additional fluid furnished from the supply line 14. In this situation, the coefficient values in the upper left cell 60 of Logic Table A are utilized. This results in the initial non-zero values for valve conductance coefficients Kvsa and Kvar being adjusted to zero and the valve conductance coefficients Kvsb and Kvbr remaining at their initial values at step 76. Note at this time the initial value of Kvsb is zero.

The adjusted set of valve conductance coefficients are applied at step 78 to the signal converter 58 which translates the coefficient for each valve into a signal indicating the level of current to be applied to open that valve the desired amount. The valve drivers 59 produce the respective current levels which are applied to the associated valves 21-24. In the present example, the adjusted set of valve conductance coefficients results in only the fourth electrohydraulic proportional valve 24 opening as only valve conductance coefficient Kvbr has a non-zero value. Opening this valve connects the rod chamber 27 of the cylinder 16 to node "r", thereby allowing fluid in the rod chamber to drain into the return line 18. As a result, the piston 28 moves upward in FIG. 1 due to the pressure trapped in the head chamber 26, which action increases the size of the head chamber a reduces the trapped pressure therein. As the rod chamber fluid is released into node "r" the pressure at that node increases. At the same time pressure at node "a" connected to the head chamber decreases. Eventually the pressures at nodes "a" and "r" equalize, at which time the trapped pressure condition has been eliminated.

By adjusting the valve conductance coefficients as designated in the cells of Logic Table A in FIG. 5, the trapped pressure within the hydraulic cylinder 16 is relieved at the outset of commanding motion. This prevents the trapped pressure from producing motion in the opposite direction to that designated by the operator.

When the trapped pressure condition no longer exists a transition occurs to another State, in this example State 2, at which the unadjusted valve conductance coefficients (Kvsa, Kvsb, Kvar, and Kvbr) are employed to operate the electrohydraulic proportional valves 21-24, as will be described. In some situations the changeover to the unadjusted valve conductance coefficients produces a velocity discontinuity from the given valve that was held closed and then opens. Although this discontinuity does not adversely affect machine operation, it is disconcerting to the machine operator. The solution is to apply a small current to the given valve, that is closed while the trapped pressure is being released. For example, this current level is achieved by setting the adjusted valve conductance coefficient for the given valve to a constant value that corresponds to 0.05 percent of the coefficient for the full open position. That preparatory coefficient value is designated $Kv_{PRE}$. The resultant current operates the pilot valve portion of the electrohydraulic proportional valve 21, 22, 23 or 24 without opening the main valve poppet, which preconditions the valve to open subsequently without producing a velocity discontinuity.

In hydraulic systems in which velocity discontinuity is a concern, the Logic Table B in FIG. 6 may be used in place of the one in FIG. 5. With this alternative Logic Table B, when the valve coefficient routine 57 is in State 1 and the low side extend metering mode has been selected, the valve conductance coefficients are adjusted as defined in the upper left cell 82. Here, the valve conductance coefficient Kvsa is set to the minimum, or lesser, of its initial value or the preparatory coefficient value $Kv_{PRE}$. Therefore, the valve conductance coefficient Kvsa is set to whichever provides the smaller pilot valve motion, the preparatory value Kv PRE or the previously determined initial valve conductance coefficient. At the same time, valve conductance coefficient Kvar is set equal to the maximum, or greater, of the initial valve conductance coefficient value or the negative of the preparatory coefficient value $Kv_{PRE}$. In the low side extend regenerative metering mode, fluid flows through the third electrohydraulic proportional valve 23 ("br") from the return line node "r" to workport node "a" which is opposite to the normal flow direction and thus is designated by negative valve coefficients. The valve conductance coefficient Kvsb is maintained at zero and valve conductance coefficient Kvbr is left unchanged at its initial value.

Referring again to FIGS. 3 and 5, alternatively when the standard extend metering mode has been selected while in State 1, a slightly different valve conductance coefficient generation process is conducted depending upon whether an inlet check valve 29 is present between the valve assembly 25 and the supply line 14. Such a check valve prevents fluid from flowing backwards through either valve 21 or 22 into the supply line. As a result, control of the first and second electrohydraulic proportional valve 21 or 22 in certain metering modes does not have to be adjusted by the valve coefficient routine 57 and the associated valve conductance coefficients are set to their initial values. Note that Kvar and Kvsb are zero in the standard extend mode. However, if the apparatus does not utilize an inlet check valve 29, then the valve conductance coefficients for the standard extend mode in State 1 are adjusted as shown in the lower portion of the table cell. Specifically, in Table A valve conductance coefficient Kvsa is set to zero while in State 1. In the corresponding cell of Table B (FIG. 6), Kvsa is set to the minimum of the preparatory coefficient value $Kv_{PRE}$ or the initially derived value of Kvsa, whichever is lesser.

Similar adjustment values are shown in the Logic Table A of FIG. 5 for the high side extend metering mode for use in States 1 and 3, and for low side retract and standard retract metering modes for use in States 4 and 6 when motion in the negative direction is commanded. Correspondingly, the other cells of the Logic Table B in FIG. 6 provide adjustments to the valve conductance coefficients that eliminate the velocity discontinuity action of the valves when normal control commences following relief of the trapped pressure.

Referring again to FIG. 3, if the operator releases the joystick 47 to stop the motion of the hydraulic function 20 while the valve coefficient routine 57 is in State 1, the velocity command goes to zero which causes a transition back to State 0. Alternatively if while in State 1, the velocity command becomes equal to greater than the trapped pressure velocity threshold ($VELOCITY_{MIN\ TP}$) or the previously negative value for pressure differential ΔPa becomes positive, a transition occurs to State 2 as compensation for the effects of trapped pressure no longer is required. After the transition to State 2, the initial valve conductance coefficients produced in the earlier processing stage by the valve coefficient routine 57 are passed directly to the signal converter 58 in FIG. 2 for use in activating the valves 21-24 of the hydraulic function 20.

A transition to State 2 also can occur directly from State 0 when the velocity command either is at least equal to the trapped pressure velocity threshold ($VELOCITY_{MIN\ TP}$) or is greater than zero and both of the pressure differentials are positive. In which case, compensation for the effects of trapped pressure is not required and the initial valve conductance coefficients are not adjusted. The valve coefficient routine 57 remains in State 2 until the velocity command from the input circuit 50 no longer is positive, i.e. motion of the hydraulic function either is to stop or reverse direction.

A transition can also occur from State 0 to State 3 in the situation where the velocity command is greater than zero, but less then the trapped pressure velocity threshold ($VELOCITY_{MIN\ TP}$) and the pressure differential ΔPa is non-negative when pressure differential ΔPb is less than zero. While the valve coefficient routine 57 is in State 3, the valve conductance coefficients are adjusted as defined by the Logic Table A or B in FIGS. 5 and 6. At this time, the bottom row of coefficient values in the Logic Table is chosen because ΔPa is greater than or equal to zero and ΔPb is less then zero. The particular cell along the bottom row that is utilized is determined based on the metering mode that has been selected. The equations within each cell specify whether a given valve conductance coefficient is adjusted and if so, how in a similar manner to the adjustments previously described with respect to State 1.

If the velocity command goes to zero while in State 3, a transition occurs back to State 0. Alternatively, if the velocity command becomes greater than or equal to the trapped pressure velocity threshold ($VELOCITY_{MIN\ TP}$), or the previously negative pressure differential ΔPb becomes positive, a transition occurs from State 3 to State 2. As previously described, the initial values of the valve conductance coefficients are utilized to operate the valves 21-24 for State 2.

When the velocity command designates motion in the negative direction, i.e. piston rod retract, the valve coefficient routine 57 operates in the States 4, 5 and 6 at the upper half of the state diagram in FIG. 3. The operation in these three upper states is similar to that described with respect to the lower states with transitions also occurring based on the magnitude of the velocity command and the two pressure differentials ΔPa and ΔPb. Specifically, transition from State 0 to State 4 occurs when the velocity is both negative and is larger than the minimum trapped pressure velocity threshold, i.e. more negative that the negative value of $VELOCITY_{MIN\ TP}$. In addition, the pressure differential ΔPa must be less than zero and ΔPb has to be greater than or equal to zero. While operating in State 4, the valve conductance coefficients are adjusted according to the upper row of Logic Table coefficient values depending upon which metering mode has been selected.

If the velocity command goes to zero while in State 4, a transition occurs back to State 0. Alternatively, if trapped pressure compensation no longer is required because the velocity command now is significantly larger (more negative) than the negative trapped pressure velocity threshold ($-VELOCITY_{MIN\ TP}$) or the previously negative pressure differential ΔPa is now positive, a transition occurs to State 5.

A transition to State 5 also may occur directly from State 0 when the velocity command is less than or equal to the minimum trapped pressure velocity or is less than zero, and the two pressure differentials ΔPa and ΔPb are both positive. This latter condition occurs when trapped pressure is not a concern. Therefore in State 5, the initially derived values of valve conductance coefficients (Kvsa, Kvsb, Kvar, and Kvbr) are left unchanged and utilized directly to control the valves. A transition occurs from State 5 to State 0 when either the motion is to stop (the velocity command equals zero) or motion is to occur in the opposite direction (velocity command greater than zero).

Operation in State 6 of the valve coefficient routine 57 occurs upon a transition from State 0. This happens when the velocity command is less than zero and is greater than the negative trapped pressure velocity threshold ($-VELOCITY_{MIN\ TP}$) while ΔPa is greater than or equal to zero and ΔPb is less than zero. While in State 6, the valve conductance coefficients are adjusted according to the bottom row of cells in the Logic Table with a particular cell selected based on the particular metering mode that is active. A transition occurs from State 6 back to State 0 when motion of the hydraulic function is to cease, i.e. the velocity command equals zero. Alternatively, a transition occurs from State 6 to State 5 when the velocity command is less than or equal to the negative minimum trapped pressure velocity or the previously negative differential pressure ΔPb becomes positive. In the first of these situations, the commanded velocity is significantly great enough to overcome the effects of the trapped pressure, while in the second of these situations, the trapped pressure has been relieved.

The valve coefficient routine 57 recognizes existence of trapped pressure within the hydraulic cylinder 16 which could adversely affect motion in the commanded direction. In response to that recognition, the valve conductance coefficients are adjusted at the outset cylinder motion to relieve the trapped pressure. In doing so the trapped pressure does not produce motion in the opposite direction to that commanded by the operator.

The foregoing description was primarily directed to a preferred embodiment of the invention. Although some attention was given to various alternatives within the scope of the invention, it is anticipated that one skilled in the art will likely realize additional alternatives that are now apparent from disclosure of embodiments of the invention. For example the present compensation technique can be used with other types of hydraulic actuators than a cylinder and piston actuator and other valve assemblies. Accordingly, the scope of the invention should be determined from the following claims and not limited by the above disclosure.

What is claimed is:

1. In a hydraulic system having a first control valve that couples a hydraulic actuator to a supply line containing pressurized fluid, and a second control valve that couples the hydraulic actuator to a return line connected to a tank; a method comprising:

receiving a command indicating desired motion of the hydraulic actuator;

determining a first pressure differential that exists across the first control valve;

determining a second pressure differential that exists across the second control valve;

ascertaining from at least one of the first pressure differential and the second pressure differential whether a trapped pressure condition exists in the hydraulic actuator in which case an active indication is produced;

when the indication is active:

(a) opening one of the first control valve and the second control valve to release the trapped pressure, and (b) determining from a change in at least one of the first pressure differential and the second pressure differential when the trapped pressure condition no longer exists and thereafter opening the other of the first control valve and the second control valve to produce the desired motion of the hydraulic actuator; and when the indication is inactive, opening both of the first control valve and the second control valve to produce the desired motion of the hydraulic actuator.

2. The method as recited in claim 1 wherein determining a first pressure differential comprises:

sensing a first pressure on one side of the first control valve;

sensing a second pressure of another side of the first control valve; and calculating a difference between the first pressure and the second pressure.

3. The method as recited in claim 1 wherein existence of a trapped pressure condition is ascertained based on an arithmetic sign of the first pressure differential.

4. The method as recited in claim 1 wherein determining a second pressure differential comprises:

sensing a first pressure on one side of the second control valve;

sensing a second pressure of another side of the second control valve; and calculating a difference between the first pressure and the second pressure.

5. The method as recited in claim 1 wherein existence of a trapped pressure condition is ascertained based on an arithmetic sign of the second pressure differential.

6. The method as recited in claim 1 wherein the change in at least one of the first pressure differential and the second pressure differential comprises a change in an arithmetic sign of the respective pressure differential.

7. The method as recited in claim 1 wherein producing an active indication also requires that the command indicate desired motion that is greater than a predefined threshold.

8. The method as recited in claim 1 wherein the other of the first control valve and the second control valve is electrically operated; and further comprising, while opening one of the first control valve and the second control valve to release the trapped pressure, applying electric current that preconditions the other of the first control valve and the second control valve for subsequent opening.

9. In a hydraulic system having a first electrohydraulic valve that couples a first port of a hydraulic actuator to a first node connected to a supply line containing pressurized fluid, a second electrohydraulic valve that couples a second port of the hydraulic actuator to the first node, a third electrohydraulic valve that couples the first port to a second node connected to a return line connected to a tank, and a fourth electrohydraulic valve that couples the second port to the second node, a method comprising:

receiving a command indicating desired motion of the hydraulic actuator;

selecting, in response to the command, which of the first, second, third and fourth electrohydraulic valves to open, thereby designating a first selected valve and a second selected valve to open;

determining a first pressure differential that exists across the first selected valve;

determining a second pressure differential that exists across the second selected valve;

opening one of the first selected valve and the second selected valve to release the trapped pressure before applying fluid into the hydraulic actuator to produce motion of the hydraulic actuator;

ascertaining from at least one of the first pressure differential and the second pressure differential whether a trapped pressure condition exists in the hydraulic actuator; and when a trapped pressure condition does not exist and opening both the first selected valve and the second selected valve to produce the desired motion of the hydraulic actuator.

10. The method as recited in claim 9 wherein opening one of the first selected valve and the second selected valve to release the trapped pressure is performed only when a trapped pressure condition is ascertained to exist.

11. The method as recited in claim 9 wherein the first electrohydraulic valve, the second electrohydraulic valve, the third electrohydraulic valve, and the fourth electrohydraulic valve are proportional valves.

12. The method as recited in claim 9 wherein selecting which of the first, second, third and fourth electrohydraulic valves to open comprises selecting a metering mode from among a standard extend mode, a standard retract mode, low side extend mode, high side extend mode, and low side retract mode.

13. The method as recited in claim 12 wherein selecting which of the first, second, third and fourth electrohydraulic valves to open is determined in response to the metering mode that has been selected.

14. The method as recited in claim 12 wherein the first pressure differential ΔPa and the second pressure differential ΔPb are determined by equations for the selected metering mode given in the following table:

| | | |
|---|---|---|
| Low Side Extend | ΔPa = Pr − Pa | ΔPb = Pb − Pr |
| Standard Extend | ΔPa = Ps − Pa | ΔPb = Pb − Pr |
| High Side Extend | ΔPa = Ps − Pa | ΔPb = Pb − Ps |
| Standard Retract | ΔPa = Pa − Pr | ΔPb = Ps − Pb |
| Low Side Retract | ΔPa = Pa − Pr | ΔPb = Pr − Pb |

where Ps is the pressure at the first node, Pr is the pressure at the second node, Pa is the pressure at the first port of a hydraulic actuator, and Pb is the pressure at the second port of a hydraulic actuator.

15. The method as recited in claim 14 wherein existence of a trapped pressure condition is ascertained based on an arithmetic sign of the first pressure differential ΔPa.

16. The method as recited in claim 14 wherein existence of a trapped pressure condition is ascertained based on an arithmetic sign of the second pressure differential.

17. The method as recited in claim 14 wherein opening one of the first selected valve and the second selected valve to release the trapped pressure also requires that the command indicate desired motion that is greater than a predefined threshold amount.

18. The method as recited in claim 14 wherein when a trapped pressure condition exists electric current is applied to prepare the other of the first selected valve and the second selected valve for opening at a time when the trapped pressure condition no longer exists.

19. In a hydraulic system having a first electrohydraulic proportional valve that couples a first port of a hydraulic actuator to a first node connected to a supply line containing pressurized fluid, a second electrohydraulic proportional valve that couples a second port of the hydraulic actuator to the first node, a third electrohydraulic proportional valve that couples the first port to a second node connected to a return line connected to a tank, and a fourth electrohydraulic proportional valve that couples the second port to the second node, a method comprising:

determining a first pressure Pa that is present at the first port;

determining a second pressure Pb that is present at the second port;

determining a third pressure Ps that is present at the first node;

determining a fourth pressure Pr that is present at the second node;

receiving a command indicating a desired velocity at which the hydraulic actuator is to operate;

deriving valve flow coefficients for each of the first, second, third, and fourth electrohydraulic proportional valves in response to the command, the first pressure and the second pressure;

determining a first pressure differential that exists between the first port and one of the first node and the second node;

determining a second pressure differential that exists between the second port and the other of the first node and the second node;

ascertaining from the first pressure differential and the second pressure differential when a trapped pressure condition exists in the hydraulic actuator;

while a trapped pressure condition exists:

(a) adjusting the valve flow coefficients to produce adjusted valve flow coefficients, and (b) controlling the first, second, third and fourth electrohydraulic proportional valves in response to the adjusted valve flow coefficients which alleviates the trapped pressure condition; and when a trapped pressure condition does not exists, controlling the first, second, third and fourth electrohydraulic proportional valves in response to the valve flow coefficients to move the hydraulic actuator at the desired velocity.

20. The method as recited in claim 19 wherein deriving valve flow coefficients for each of the first, second, third, and fourth electrohydraulic proportional valves also is in response to the third pressure and the fourth pressure.

21. The method as recited in claim 19 wherein deriving valve flow coefficients comprises selecting a metering mode from among a standard extend mode, a standard retract mode, low side extend mode, high side extend mode, and low side retract mode.

22. The method as recited in claim 21 wherein the first pressure differential ΔPa and the second pressure differential ΔPb are determined by equations for the selected metering mode given in the following table:

| | | |
|---|---|---|
| Low Side Extend | ΔPa = Pr − Pa | ΔPb = Pb − Pr |
| Standard Extend | ΔPa = Ps − Pa | ΔPb = Pb − Pr |
| High Side Extend | ΔPa = Ps − Pa | ΔPb = Pb − Ps |
| Standard Retract | ΔPa = Pa − Pr | ΔPb = Ps − Pb |
| Low Side Retract | ΔPa = Pa − Pr | ΔPb = Pr − Pb |

where Ps is the pressure at the first node, Pr is the pressure at the second node, Pa is the pressure at the first port of a hydraulic actuator, and Pb is the pressure at the second port of a hydraulic actuator.

23. The method as recited in claim 22 wherein existence of a trapped pressure condition is ascertained in response to an arithmetic sign of the first pressure differential ΔPa.

24. The method as recited in claim 22 wherein existence of a trapped pressure condition is ascertained in response to an arithmetic sign of the second pressure differential ΔPb.

25. The method as recited in claim 19 wherein ascertaining when a trapped pressure condition exists also requires that the command indicate a desired velocity that is greater than a predefined threshold velocity.

* * * * *